US012279670B2

(12) United States Patent
Mitsuhata et al.

(10) Patent No.: US 12,279,670 B2
(45) Date of Patent: Apr. 22, 2025

(54) PLATE, SOLE, AND SHOE

(71) Applicant: ASICS CORPORATION, Kobe (JP)

(72) Inventors: Yoshikazu Mitsuhata, Kobe (JP); Takayuki Kogure, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 17/936,702

(22) Filed: Sep. 29, 2022

(65) Prior Publication Data

US 2023/0104731 A1 Apr. 6, 2023

(30) Foreign Application Priority Data

Oct. 5, 2021 (JP) ..... 2021-164112

(51) Int. Cl.
*A43B 13/18* (2006.01)

(52) U.S. Cl.
CPC ..... *A43B 13/18* (2013.01)

(58) Field of Classification Search
CPC ..... A43B 13/18; A43B 13/12; A43B 13/127; A43B 13/16; A43B 13/185; A43B 7/32
See application file for complete search history.

(56) References Cited

U.S. PATENT DOCUMENTS 5,042,176 A * 8/1991 Rudy ..... A43B 13/206 36/153
6,023,861 A * 2/2000 Bizzotto ..... A43B 13/12 36/179
6,151,803 A * 11/2000 Charles ..... A43B 13/141 36/85
6,314,664 B1 * 11/2001 Kita ..... A43B 13/12 36/31
7,096,605 B1 8/2006 Kozo et al.
7,886,461 B2 * 2/2011 Sato ..... A43B 13/183 36/27

(Continued)

FOREIGN PATENT DOCUMENTS

JP 2018-534028 A 11/2018
WO 2017/058419 A1 4/2017

OTHER PUBLICATIONS

The extended European search report issued by the European Patent Office on Jan. 27, 2023, which corresponds to European Patent Application No. 22196639.3-1015 and is related to U.S. Appl. No. 17/936,702.

(Continued)

*Primary Examiner* — Bao-Thieu L Nguyen
(74) *Attorney, Agent, or Firm* — Studebaker Brackett PLLC

(57) ABSTRACT

A plate is used for a sole forming a part of a shoe. The plate includes a front support portion and a center support portion. The front support portion is formed in a flat shape or a curved shape with a single downward protrusion in a cross section in a foot width direction, when the sole is placed on a flat plane. The center support portion has a shape with an upward protrusion and a downward protrusion arranged alternately in the foot width direction in a cross section in the foot width direction, when the sole is placed on the flat plane, where the upward protrusion has a shape curved to protrude upward and the downward protrusion has a shape curved to protrude downward.

7 Claims, 11 Drawing Sheets

(56) References Cited

U.S. PATENT DOCUMENTS

| | | | | |
|---|---|---|---|---|
| 8,567,093 | B2 * | 10/2013 | Sato | A43B 13/12 36/27 |
| 10,010,137 | B2 * | 7/2018 | Foxen | A43B 13/42 |
| 10,765,172 | B2 * | 9/2020 | Foxen | A43B 13/14 |
| 11,006,695 | B2 * | 5/2021 | Chambers | A43B 13/186 |
| 11,559,104 | B2 * | 1/2023 | Chambers | A43B 13/185 |
| 2008/0052965 | A1 * | 3/2008 | Sato | A43B 13/026 36/103 |
| 2011/0113656 | A1 * | 5/2011 | Sato | A43B 7/1445 36/30 R |
| 2016/0029741 | A1 * | 2/2016 | Foxen | A43B 13/188 36/103 |
| 2018/0092431 | A1 * | 4/2018 | Iuchi | A43B 13/026 |
| 2018/0271215 | A1 * | 9/2018 | Foxen | A43B 13/125 |
| 2018/0338568 | A1 * | 11/2018 | Chambers | A43B 13/186 |
| 2019/0365030 | A1 * | 12/2019 | Chambers | A43B 13/14 |
| 2020/0100565 | A1 * | 4/2020 | Yoshida | A43B 13/026 |
| 2020/0305543 | A1 | 10/2020 | Kajiwara et al. | |
| 2020/0383422 | A1 * | 12/2020 | Bidal | A43B 13/41 |
| 2020/0390191 | A1 * | 12/2020 | Foxen | A43B 13/187 |
| 2021/0227928 | A1 * | 7/2021 | Chambers | A43B 13/12 |
| 2022/0151337 | A1 * | 5/2022 | Fujita | A43B 13/187 |
| 2022/0312891 | A1 * | 10/2022 | Yoshida | A43B 13/185 |
| 2022/0378145 | A1 * | 12/2022 | Tateno | A43B 13/125 |

OTHER PUBLICATIONS

Communication pursuant to Article 94(3) EPC issued by the European Patent Office on Dec. 18, 2023, which corresponds to European Patent Application No. 22196639.3-1015 and is related to U.S. Appl. No. 17/936,702.

* cited by examiner

PLATE, SOLE, AND SHOE

This nonprovisional application is based on Japanese Patent Application No. 2021-164112 filed on Oct. 5, 2021 with the Japan Patent Office, the entire contents of which are hereby incorporated by reference.

BACKGROUND OF THE INVENTION

Field of the Invention

The present disclosure relates to a plate, a sole, and a shoe.

Description of the Background Art

Shoes having a plate disposed in a midsole have been known. For example, Japanese Patent Publication No. 2018-534028 discloses a sole structure including an outsole, a cushioning member disposed on the outsole, a midsole disposed on the cushioning member, and a footwear plate disposed between the cushioning member and the midsole.

SUMMARY OF THE INVENTION

For the sole like the one disclosed in Japanese Patent Publication No. 2018-534028, in order to enhance the impact cushioning property in the ground contact phase, the material forming the midsole may be reduced in weight and/or hardness. In this case, for the sake of preventing wearer's injury and/or maintaining good performance, the shoe is required to have higher stability. This object can be achieved for example by suppressing arch falling from the ground contact phase to the take-off phase, and suppressing excessive deformation of the midsole in the take-off phase.

An object of the present disclosure is to provide a plate, a sole, and a shoe that enable both the suppression of arch falling from the ground contact phase to the take-off phase and the suppression of excessive deformation of the midsole in the take-off phase.

A plate according to an aspect of the present disclosure is a plate to be used for a sole forming a part of a shoe. The plate includes: a front support portion that is formed at a position overlapping, in a thickness direction of the sole, MP joints of a wearer of the shoe, and supports a forefoot portion of the wearer; and a center support portion that has a shape extending rearward from the front support portion, is formed at a position overlapping, in the thickness direction of the sole, metatarsal bones of the wearer of the shoe, and supports at least a midfoot portion of the wearer. The front support portion is formed in a flat shape or a curved shape with a single downward protrusion in a cross section in a foot width direction, when the sole is placed on a flat plane. The center support portion has a shape with an upward protrusion and a downward protrusion arranged alternately in the foot width direction in a cross section in the foot width direction, when the sole is placed on the flat plane, wherein the upward protrusion has a shape curved to protrude upward and the downward protrusion has a shape curved to protrude downward.

A sole according to an aspect of the present disclosure includes: the plate; and a midsole forming a part of the sole. The midsole supports the plate in such a manner that, when the sole is placed on the flat plane, a boundary between the front support portion and the center support portion is located at a lowermost point of the plate and a part of the plate that is located rearward of the boundary has a posture separated gradually away from the flat plane, toward a rear in a longitudinal direction of the shoe.

A shoe according to an aspect of the present disclosure includes: the sole; and an upper connected to the sole and located over the sole.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
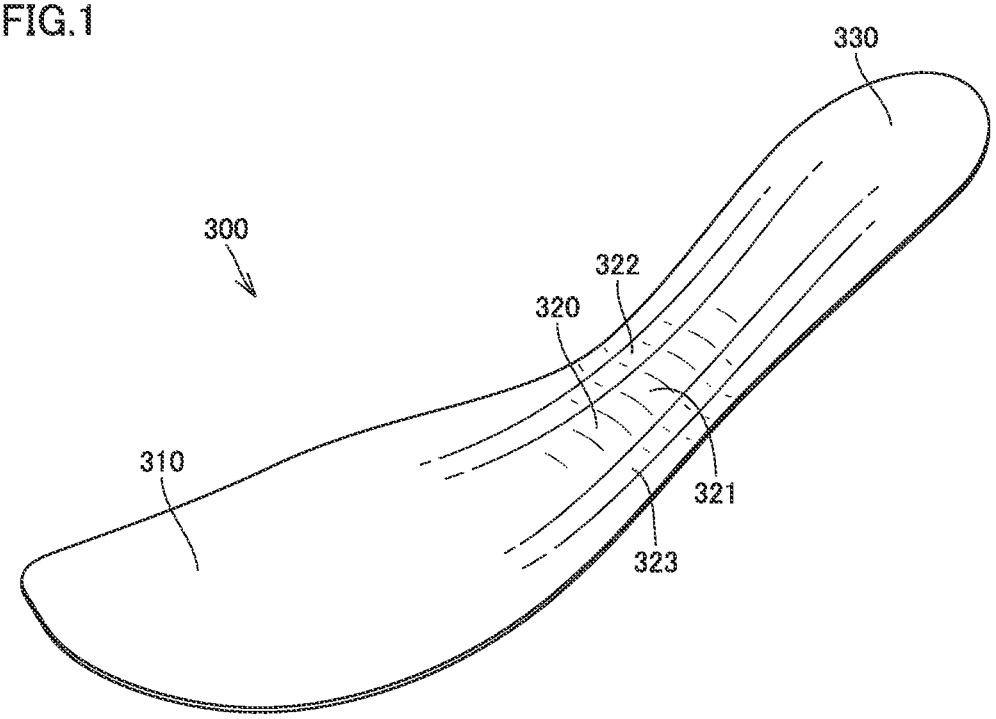
FIG. 1 is a perspective view schematically showing a plate to be used for a shoe, according to one embodiment of the present disclosure.

Embodiments of the present disclosure are described with reference to the drawings. In the drawings referenced below, the same or corresponding parts are denoted by the same reference numerals. In the following description, terms such as foot length direction, foot width direction, frontward, rearward are used. Each of these terms representing a direction indicates the direction as seen from a viewpoint of a wearer of a shoe 1 placed on a flat plane P (see FIG. 3) such as ground. For example, frontward refers to toward the toe and rearward refers to toward the heel. Moreover, inner side refers to the inner side (first-toe side) of the foot in the foot width direction, and outer side refers to the outer side of the foot in the foot width direction.

Figure 2:
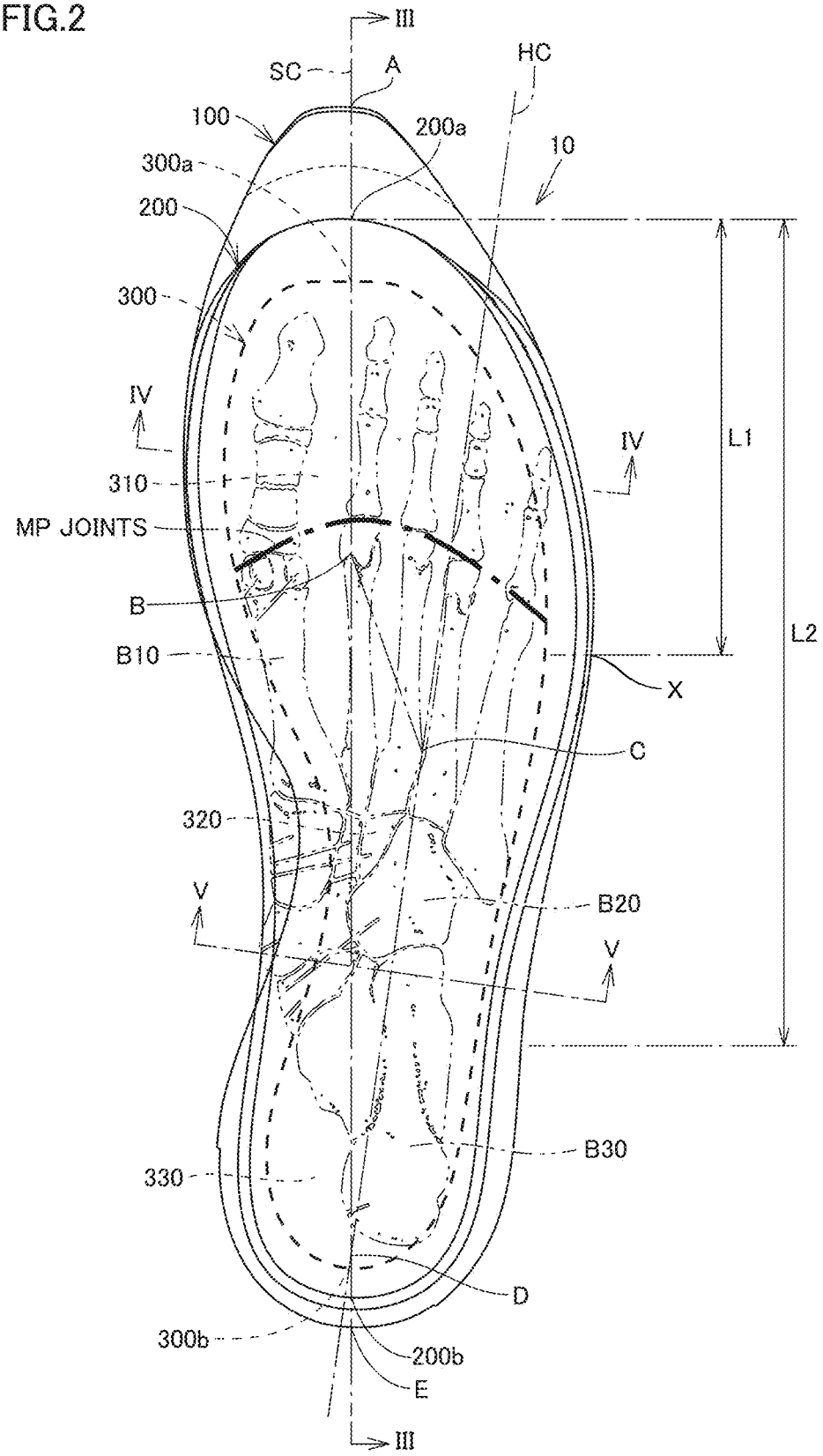
FIG. 2 is a plan view showing a relation between a sole including a plate and foot bones of a wearer of a shoe.
Figure 3:
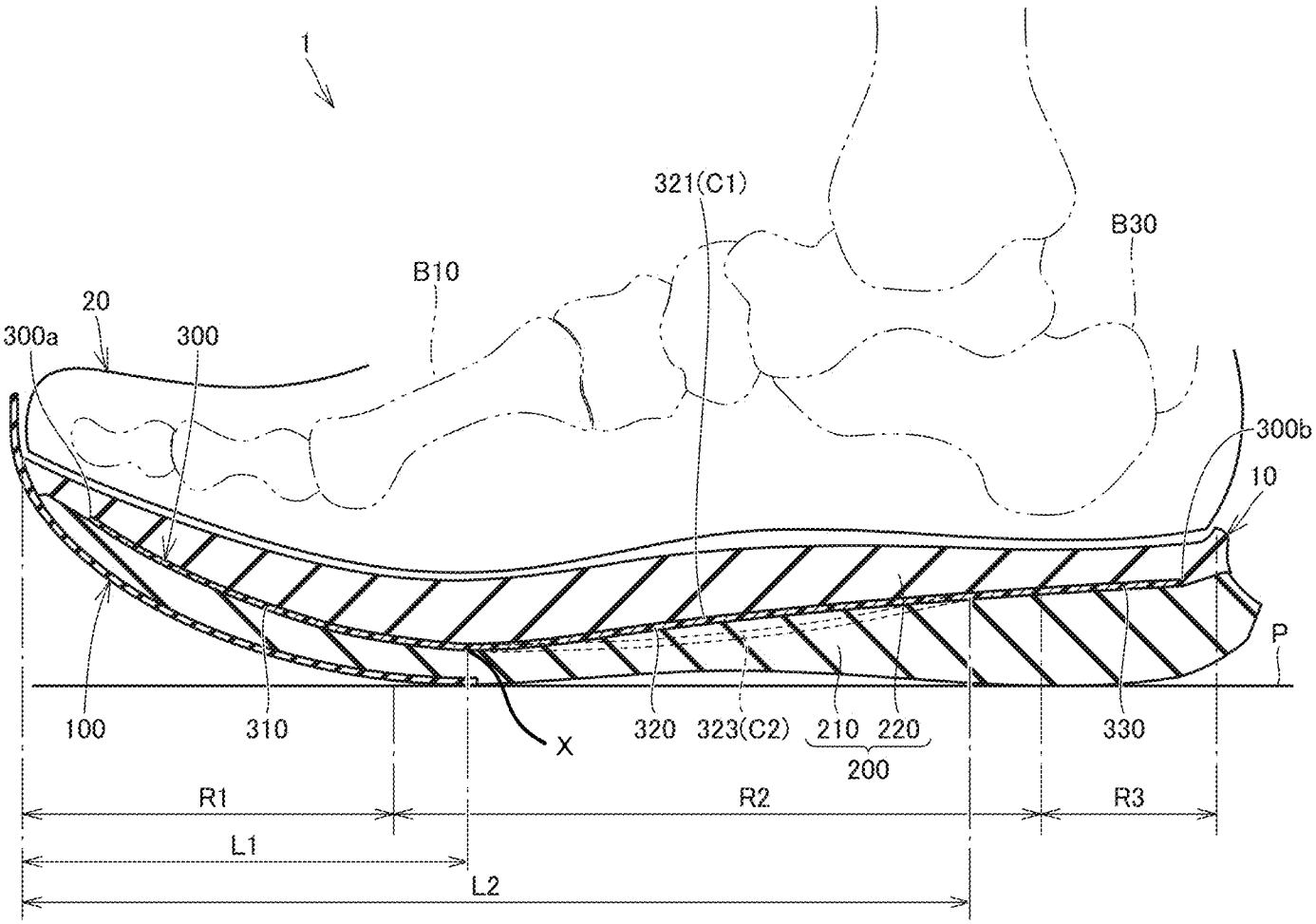
FIG. 3 is a cross-sectional view along a line III-III in FIG. 2.

FIG. 1 is a perspective view schematically showing a plate to be used for a shoe, according to one embodiment of the present disclosure. FIG. 2 is a plan view showing a relation between a sole including a plate and foot bones of a wearer of a shoe. FIG. 3 is a cross-sectional view along a line III-III in FIG. 2.

FIG. 1 shows a plate 300 for the left foot, and FIG. 2 shows a plate 300 for the right foot. These plates have respective shapes in bilateral symmetry with each other, or respective shapes nearly identical thereto. The same applies as well to soles 10 and shoes 1 including respective plates 300. The shoe 1 according to the present embodiment is applicable for use as a sports shoe such as running shoe or a walking shoe, for example, and the use of the shoe 1 is not limited to them.

As shown in FIG. 3, the shoe 1 includes the sole 10 and an upper 20.

The upper 20 is connected to the sole 10 and located over the sole 10. The upper 20 and the sole 10 together form a space for receiving a foot of a wearer.

As shown in FIG. 3, the sole 10 includes an outsole 100, a midsole 200, and a plate 300.

The outsole 100 forms a ground contact portion. The outsole 100 is made from rubber or the like.

The midsole 200 is placed over the outsole 100. The midsole 200 is formed from a resin foam material or the like. The upper 20 is disposed on this midsole 200. Namely, the midsole 200 is disposed between the upper 20 and the outsole 100. As shown in FIG. 3, the midsole 200 includes a forefoot region R1, a midfoot region R2, and a rearfoot region R3.

The forefoot region R1 is a region overlapping, in the thickness direction of the sole 10, a forefoot portion of a wearer of the shoe 1. The forefoot portion is a part of the foot of the wearer that is located frontward in the longitudinal direction of the shoe 1, i.e., the foot length direction (top-to-bottom direction in FIG. 2) of the shoe 1. The forefoot region R1 is a region located to extend over a range of approximately 0% to 30% with respect to the total length of the shoe 1, from the front end of the shoe 1 toward the rear end thereof.

The foot length direction is a direction parallel to a shoe center SC (see FIG. 2). The shoe center SC is not limited to the centerline of the shoe 1, but may be a line corresponding to a straight line connecting the calcaneus bone B30 of a standard wearer of the shoe 1 and a point between the first toe and the second toe of the wearer.

The midfoot region R2 is a region overlapping, in the thickness direction of the sole 10, a midfoot portion of a wearer of the shoe 1. The midfoot portion is a part of the foot of the wearer located centrally in the longitudinal direction. The midfoot region R2 is a region located to extend over a range of approximately 30% to 80% with respect to the total length of the shoe 1, in the direction from the front end of the shoe 1 toward the rear end thereof.

The rearfoot region R3 is a region overlapping, in the thickness direction of the sole 10, a rearfoot portion of a wearer of the shoe 1. The rearfoot portion is a part of the foot of the wearer that is located rearward in the longitudinal direction. The rearfoot region R3 is a region located to extend over a range of 80% to 100% with respect to the total length of the shoe 1, in the direction from the front end of the shoe 1 toward the rear end thereof.

As shown in FIG. 3, the midsole 200 includes a lower midsole 210 and an upper midsole 220.

The lower midsole 210 is disposed on the outsole 100. Namely, the lower surface of the lower midsole 210 is covered with the outsole 100. The lower surface of the lower midsole 210 may be covered only partially with the outsole 100, or the entire region of the lower surface thereof may be covered with the outsole 100.

The upper midsole 220 is connected onto the lower midsole 210. The upper midsole 220 may have a higher compressive elastic modulus than the compressive elastic modulus of the lower midsole 210, or the same compressive elastic modulus as the compressive elastic modulus of the lower midsole 210.

The plate 300 forms a part of the sole 10. The plate 300 has a higher bending rigidity than the bending rigidity of the midsole 200. The plate 300 is made from a fiber-reinforced resin or non-fiber-reinforced resin. Examples of the fiber used for the fiber-reinforced resin include carbon fiber, glass fiber, aramid fiber, Dyneema® fiber, Zylon® fiber, boron fiber, and the like. Examples of the non-fiber-reinforced resin include polymer resins such as polyurethane-based thermoplastic elastomer (TPU) and amide-based thermoplastic elastomer (TPA).

The plate 300 is disposed in the midsole 200. As shown in FIG. 3, the plate 300 is disposed within the midsole 200 in the present embodiment. Specifically, the plate 300 is disposed between the lower midsole 210 and the upper midsole 220. The plate 300 is bonded to at least one of the lower midsole 210 and the upper midsole 220. The midsole 200 has a receptacle defining a space in which the plate 300 is received. The receptacle has a shape corresponding to the shape of the plate 300. In the present embodiment, the receptacle is formed in the lower surface of the upper midsole 220.

The plate 300 includes a front support portion 310, a center support portion 320, and a rear support portion 330.

The front support portion 310 is a part that supports the forefoot portion of a wearer of the shoe 1. The front support portion 310 is formed at a position overlapping, in the thickness direction of the sole 10, MP joints of the foot of the wearer. As shown in FIG. 2, the front support portion 310 is formed to extend over a range from a front end 300*a* of the plate 300 to a position X at a first length L1 from a front end 200*a* of the midsole 200 toward a rear end 200*b* thereof. The first length L1 is a length of 35% of the length from the front end 200*a* to the rear end 200*b* of the midsole 200.

Figure 4:
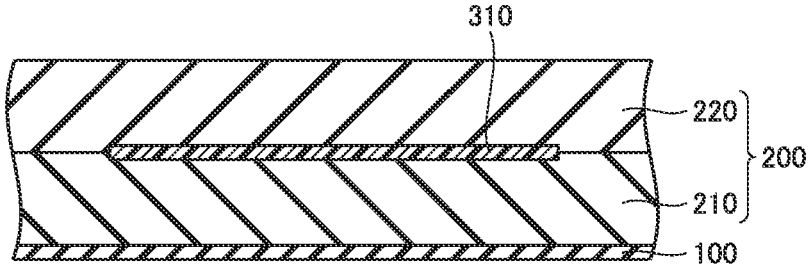
FIG. 4 is a cross-sectional view along a line IV-IV in FIG. 2.

FIG. 4 schematically shows a cross section of the shoe 1 in the foot width direction, at a position passing the front support portion 310. The front support portion 310 is formed flat as seen in the cross section in the foot width direction as shown in FIG. 4, when the sole 10 is placed on the flat plane P (see FIG. 3). In the present embodiment, the front support portion 310 is formed to have a flat cross section in the foot width direction over its entire region. The front support portion 310 may be formed in a curved shape with a single downward protrusion in a cross section in the foot width direction, when the sole 10 is placed on the flat plane P.

The center support portion 320 is a part that supports at least the midfoot portion of the wearer. The center support portion 320 has a shape extending rearward from the front support portion 310. Namely, the front support portion 310 and the center support portion 320 are contiguous to each other in the foot length direction. The center support portion 320 is formed at a position that overlaps at least metatarsal bones B10 of the wearer of the shoe 1 in the thickness direction of the sole 10. In the present embodiment, the center support portion 320 has a shape that extends from the position overlapping, in the thickness direction of the sole 10, the metatarsal bones B10 of the wearer to a position overlapping the cuboid hone B20.

As shown in FIG. 2, the center support portion 320 is formed to extend over a range from the rear end of the front support portion 310 to a position at a second length L2 from the front end 200*a* of the midsole 200 toward the rear end 200*b* thereof. The second length L2 is a length that is 75% of the length from the front end 200*a* to the rear end 200*b* of the midsole 200.

Figure 5:
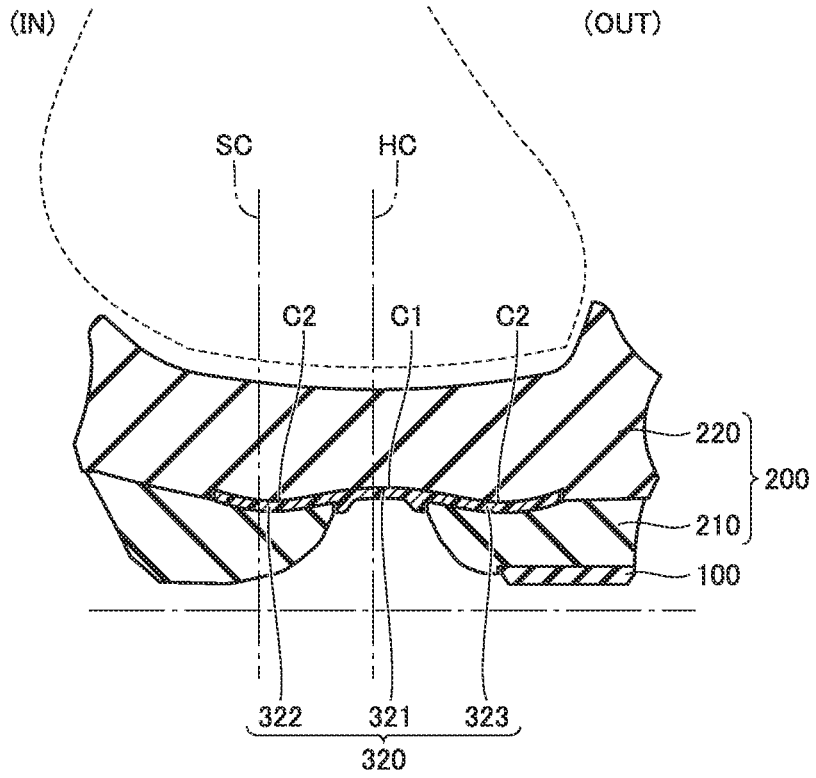
FIG. 5 is a cross sectional view along a line V-V in FIG. 2.

The center support portion 320 has a shape with an upward protrusion C1 and a downward protrusion C2 arranged alternately in the foot width direction, in a cross section in the foot width direction as shown in FIG. 5, when the sole 10 is placed on the flat plane P, where the upward protrusion C1 has a shape curved to protrude upward and the downward protrusion C2 has a shape curved to protrude downward. In FIG. 5, "IN" refers to the inner side in the foot width direction, and "OUT" refers to the outer side in the foot width direction. This is applied as well to other drawings.

In the present embodiment, the center support portion 320 includes a center projection 321, an inner projection 322, and an outer projection 323.

The center projection 321 is formed centrally in the foot width direction. As shown in FIG. 5, the center projection 321 is located on a heel center HC. The heel center HC refers to a straight line connecting the center of the calcaneus bone B30 of a standard wearer of the shoe 1 and a point between the third toe and the fourth toe.

The inner projection 322 is formed inward of the center projection 321 and contiguously to the center projection 321 in the foot width direction. The outer projection 323 is formed outward of the center projection 321 and contiguously to the center projection 321 in the foot width direction.

In the present embodiment, the center projection 321 is formed by the upward protrusion C1 and the inner projection 322 and the outer projection 323 are each formed by the downward protrusion C2. Instead, the center projection 321 may be formed by the downward protrusion C2 and the inner projection 322 and the outer projection 323 may each be formed by the upward protrusion C1. The curvature of the center projection 321, the curvature of the inner projection 322, and the curvature of the outer projection 323 may be identical to each other.

As shown in FIG. 3, the length L3 from the upper end of the center projection 321 (upward protrusion C1) to the lower end of the outer projection 323 (downward protrusion C2) is largest in a center portion of the center support portion 320 in the foot length direction, and decreases gradually from the center portion toward the front support portion 310 or the rear support portion 330. In FIG. 3, the lower end of the downward protrusion C2 is indicated by a broken line.

FIG. 3 is a cross section of the shoe 1 along a line segment AB, a line segment BC, a line segment CD, and a line segment DE shown in FIG. 2. A point A is a point of intersection of the shoe center SC and the front end of the sole 10. A point B is a point of intersection of a front part of the second metatarsal bone and the shoe center SC. A point C is a point of intersection of a rear part of the fourth metatarsal bone and the heel center HC. A point D is a point of intersection of the heel center HC and a rear end 300*b* of the plate 300. A point E is a point of intersection of the shoe center SC and the rear end of the sole 10.

As shown in FIG. 5, in the state in which the sole 10 is placed on the flat plane P, the opposite ends of the center support portion 320 in the foot width direction are not parallel with the flat plane P.

The rear support portion 330 is a part that supports the rearfoot portion of a wearer of the shoe 1. The rear support portion 330 has a shape extending rearward from the center support portion 320. Namely, the center support portion 320 and the rear support portion 330 are contiguous to each other in the foot length direction. The rear support portion 330 is formed at a position that overlaps, in the thickness direction of the sole 10, the calcaneus bone B30 of the wearer, more specifically at a position that overlaps the lowermost point of the calcaneus bone 930. The rear support portion 330 is formed to extend over a range from the rear end of the center support portion 320 to the rear end 300*b* of the plate 300. The rear support portion 330 is formed such that its cross section in the foot width direction is flat. Note that the rear support portion 330 may not be provided.

As shown in FIG. 3, the midsole 200 supports the plate 300 in such a manner that, when the sole 10 is placed on the flat plane P, the boundary between the front support portion 310 and the center support portion 320 is located at the lowermost point (i.e., position X) of the plate 300 and a part of the plate 300 that is located rearward of the boundary has a posture separated gradually away from the flat plane P, toward the rear in the longitudinal direction of the shoe 1.

In the plate 300 of the present embodiment described above, the center support portion 320 has a shape with the upward protrusion C1 and the downward protrusion C2 arranged alternately in the foot width direction, which thereby ensures a sufficient bending rigidity of the center support portion 320 in the foot length direction. Therefore, arch falling from the ground contact phase to the take-off phase is suppressed. Further, the front support portion 310 and the center support portion 320 are contiguous to each other in the foot length direction, which thereby suppresses excessive deformation of the midsole 200 in the take-off phase.

In the following, modifications of the above embodiment are described.

Modification 1

Figure 6:
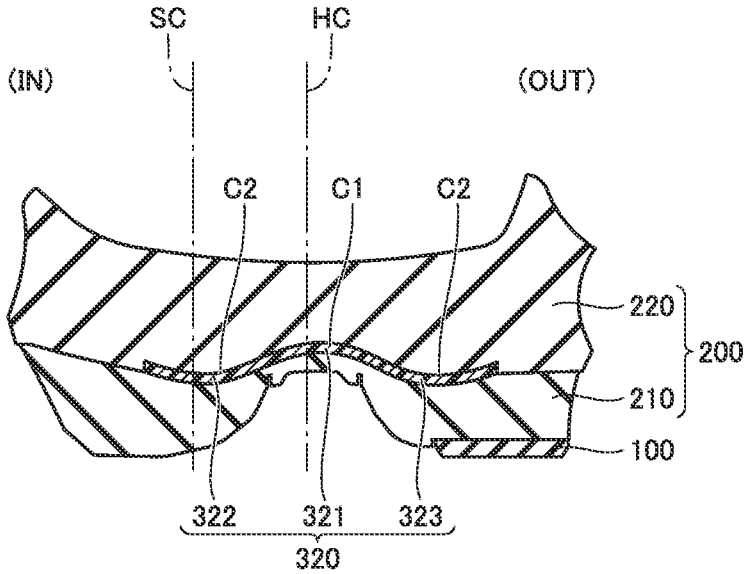
FIG. 6 is a cross-sectional view showing a modification of a center support portion.

As shown in FIG. 6, the curvature of the center projection 321 may be smaller than the curvature of inner projection 322 and the curvature of the outer projection 323. In this case, while the bending rigidity of the center support portion 320 in the foot length direction is somewhat decreased relative to the above embodiment, the cushioning effect in the ground contact phase is increased.

Modification 2

Figure 7:
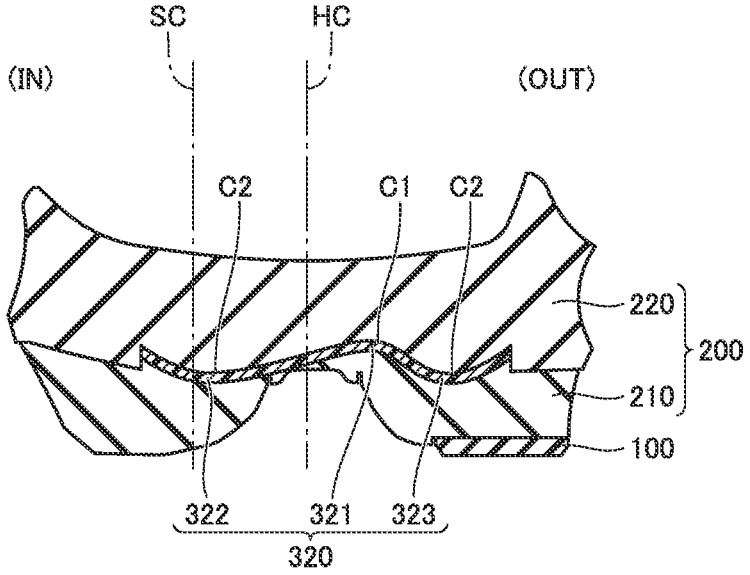
FIG. 7 is a cross-sectional view showing a modification of the center support portion.

As shown in FIG. 7, the apex of the center projection 321 may be shifted away from the heel center HC toward the lateral foot side. In this case, smooth weight transfer is achieved in the transition from the ground contact phase to the take-off phase.

Modification 3

Figure 8:
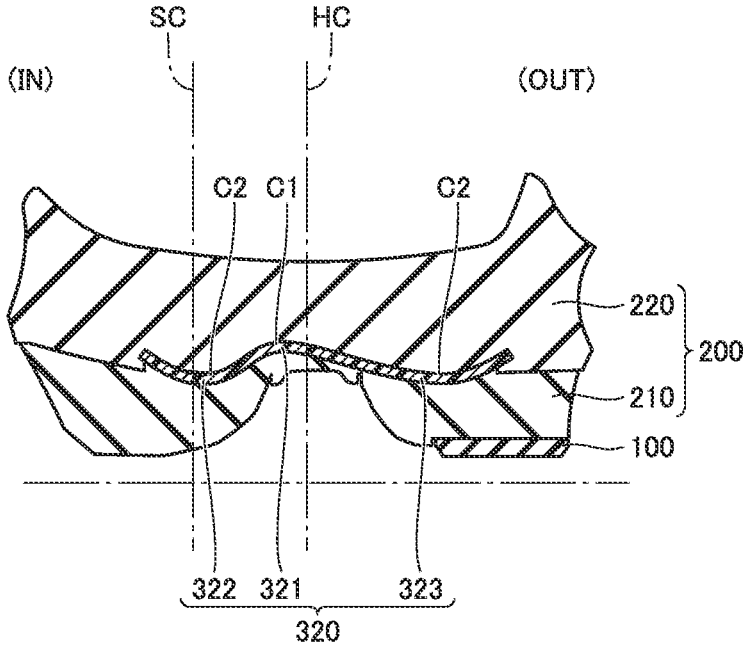
FIG. 8 is a cross-sectional view showing a modification of the center support portion.

As shown in FIG. 8, the apex of the center projection 321 may be shifted away from the heel center HC toward the medial foot side. In this case, the bending rigidity of a part of the center support portion 320 that is located inward of the heel center HC is increased, which thereby suppresses occurrence of pronation in the ground contact phase.

Modification 4

Figure 9:
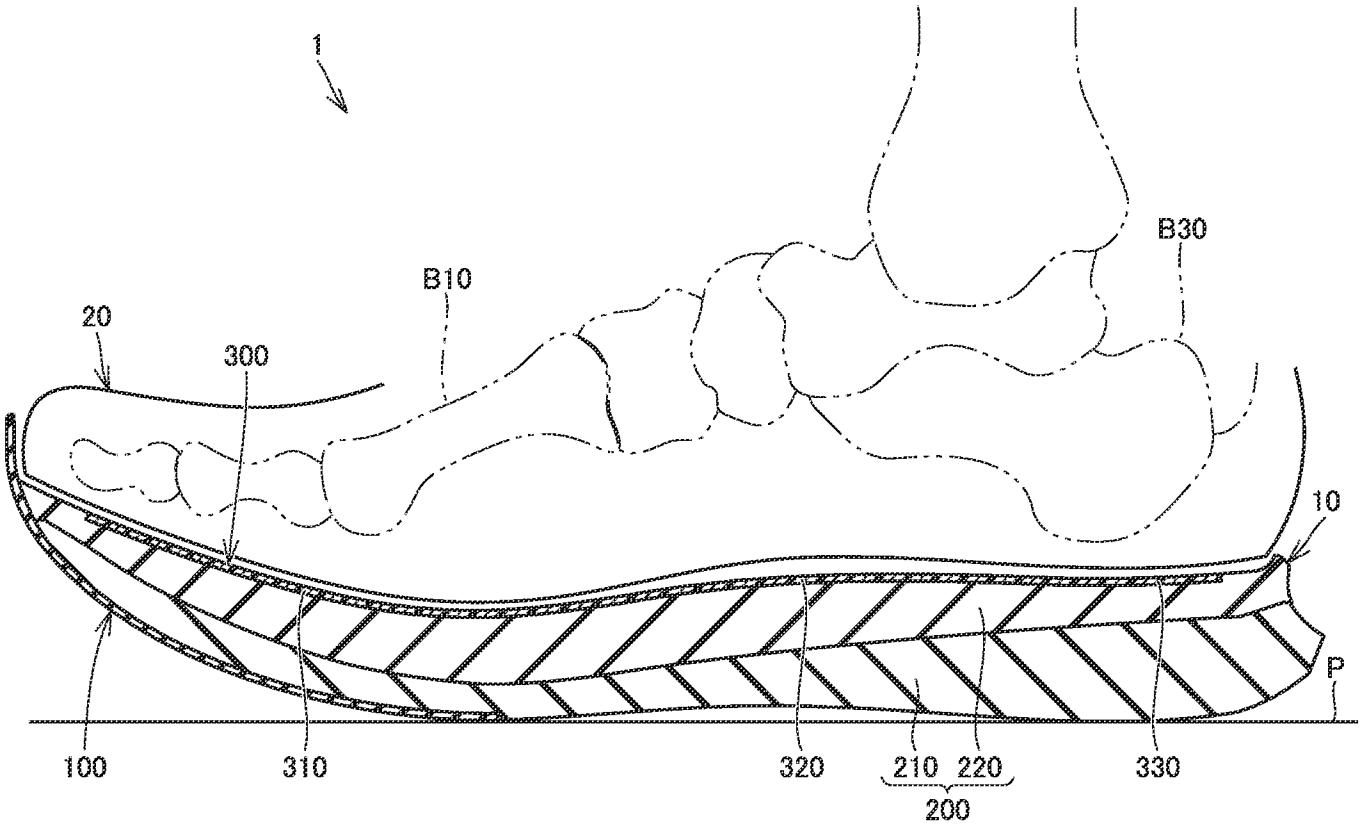
FIG. 9 shows a modification of a positioning relation between a midsole and a plate.

As shown in FIG. 9, the plate 300 may be placed in the front surface of the midsole 200 (the front surface of the upper midsole 220). In this case, the midsole 200 may have a monolayer structure. In this case, the efficiency of load transmission from the wearer's foot to the plate 300 is increased, and therefore, force of the foot is transferred effectively to the ground.

Modification 5

Figure 10:
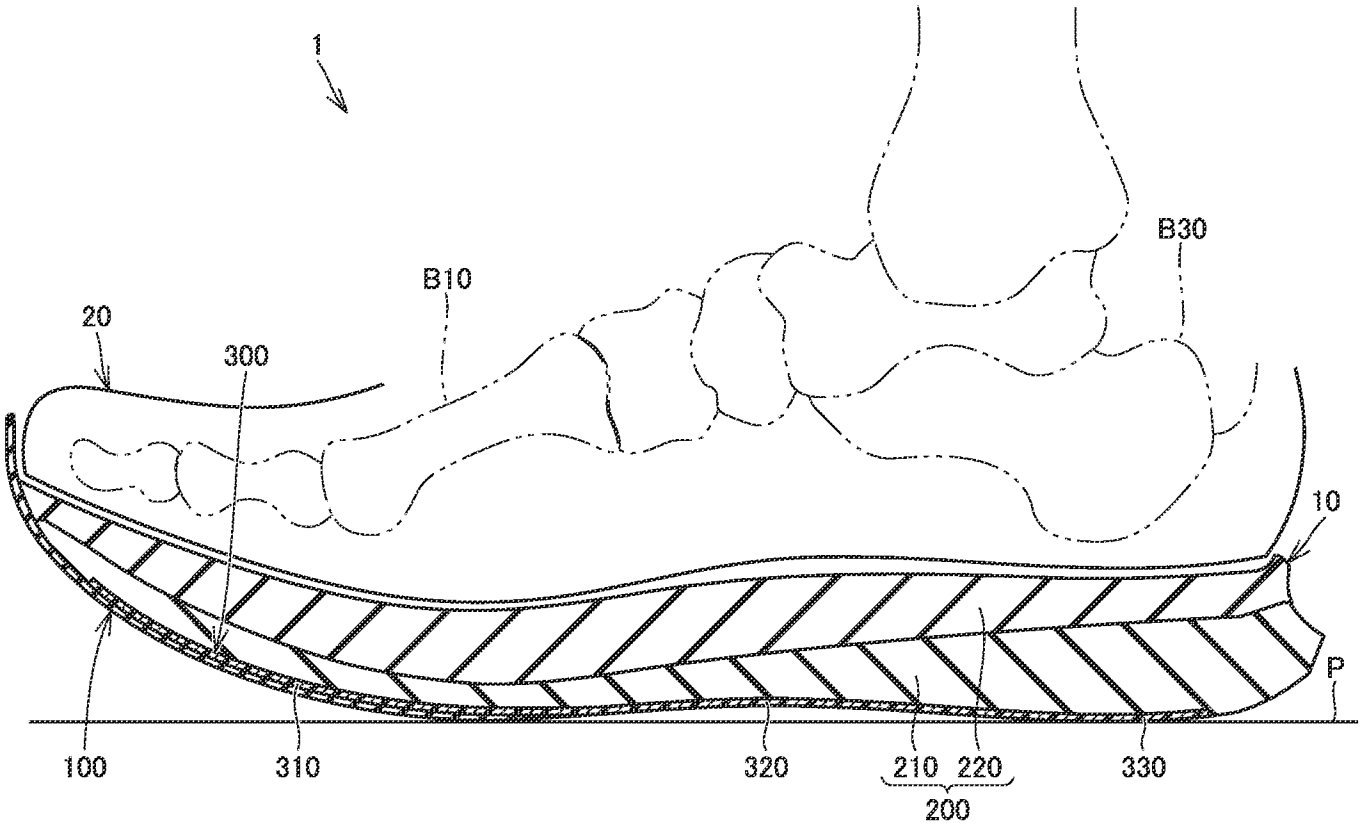
FIG. 10 shows a modification of a positioning relation between the midsole and the plate.
Figure 11:
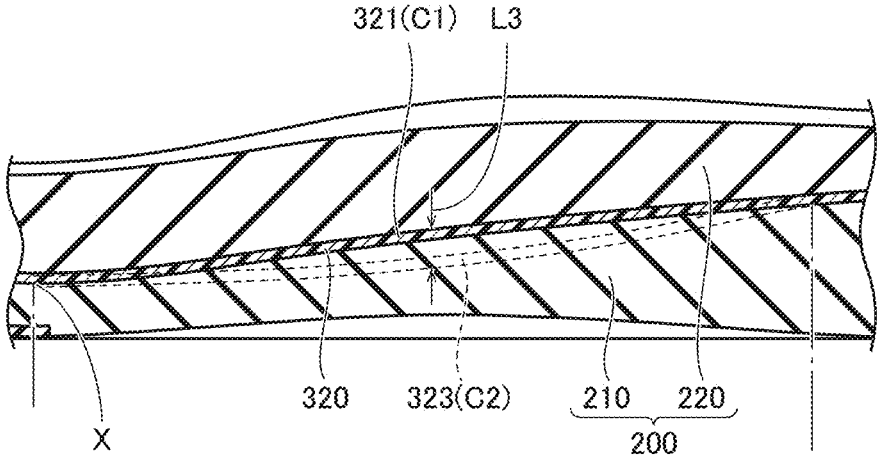
FIG. 11 is a partial enlarged view of FIG. 3.

As shown in FIG. 10, the plate 300 may be placed to be in contact with the hack surface of the midsole 200 (the back surface of the lower midsole 210). In this case, the midsole 200 may have a monolayer structure. In this case, a larger distance from the foot to the plate 300 is ensured, and therefore, the midsole 200 effectively alleviates the impact applied to the foot in the ground contact phase.

[Aspects]

It would be appreciated by those skilled in the art that a plurality of above-described illustrative embodiments are specific examples of the aspects as set forth below.

A plate according to an aspect of the present disclosure is a plate to be used for a sole forming a part of a shoe. The plate includes: a front support portion that is formed at a position overlapping, in a thickness direction of the sole, MP joints of a wearer of the shoe, and supports a forefoot portion of the wearer; and a center support portion that has a shape extending rearward from the front support portion, is formed at a position overlapping, in the thickness direction of the sole, metatarsal bones of the wearer of the shoe, and supports at least a midfoot portion of the wearer. The front support portion is formed in a flat shape or a curved shape with a single downward protrusion in a cross section in a foot width direction, when the sole is placed on a flat plane. The center support portion has a shape with an upward protrusion and a downward protrusion arranged alternately in the foot width direction in a cross section in the foot width direction, when the sole is placed on the flat plane, wherein the upward protrusion has a shape curved to protrude upward and the downward protrusion has a shape curved to protrude downward.

In this plate, the center support portion has the upward protrusion and the downward protrusion arranged alternately in the foot width direction, which ensures a sufficient bending rigidity of the center support portion in the foot length direction. Thus, arch falling from the ground contact phase to the take-off phase is suppressed. Further, the front support portion and the center support portion are contiguous to each other in the foot length direction, which suppresses excessive deformation of the midsole in the take-off phase.

Preferably, the center support portion has a shape extending to a position overlapping, in the thickness direction of the sole, a cuboid bone of the wearer.

In this way, the above-described advantageous effects are more reliably obtained.

Preferably, the center support portion includes: a center projection formed centrally in the foot width direction; an inner projection formed inward of the center projection and contiguously to the center projection in the foot width direction; and an outer projection formed outward of the center projection and contiguously to the center projection in the foot width direction.

In this way, the inner projection effectively suppresses arch falling and the outer projection increases the bending rigidity, which thereby effectively supports the load generated by weight transfer from the ground contact phase to the take-off phase.

Preferably, the center projection is formed by the upward protrusion, and the inner projection and the outer projection are each formed by the downward protrusion.

In this way, an entirely balanced and sufficient bending rigidity in the foot length direction is ensured.

Preferably, a curvature of the center projection, a curvature of the inner projection, and a curvature of the outer projection are identical to each other. In this way, the rigidity of the center support portion in the foot length direction and the cushioning property in the ground contact phase are well-balanced.

A sole according to one aspect of the present disclosure includes: the plate; and a midsole forming a part of the sole. The midsole supports the plate in such a manner that, when the sole is placed on the flat plane, a boundary between the front support portion and the center support portion is located at a lowermost point of the plate and a part of the plate that is located rearward of the boundary has a posture separated gradually away from the flat plane, toward a rear in a longitudinal direction of the shoe.

This sole ensures a sufficient thickness of the part of the midsole that is located downward of the rear end of the plate, which thereby effectively suppresses rearfoot falling from the ground contact phase to the take-off phase.

A shoe according to an aspect of the present disclosure includes: the sole; and an upper connected to the sole and located over the sole.

It should be construed that embodiments disclosed herein are given by way of illustration in all respects, not by way of limitation. It is intended that the scope of the present invention is defined by claims, not by the description above, and encompasses all modifications and variations equivalent in meaning and scope to the claims.

What is claimed is:

1. A sole comprising:

a plate, a midsole forming a part of the sole, and an outsole forming a ground contact portion, wherein the plate includes a front support portion that is at a position configured to overlap, in a thickness direction of the sole, MP joints of a wearer of the sole, and is configured to support a forefoot portion of the wearer; and a center support portion that has a shape extending rearward from the front support portion, is at a position configured to overlap, in the thickness direction of the sole, metatarsal bones of the wearer of the sole, and is configured to support at least a midfoot portion of the wearer, wherein the front support portion is configured in a curved shape with a single downward protrusion in a cross section in a foot width direction, when the sole is placed on a flat plane, and the center support portion has a shape with an upward protrusion and a downward protrusion arranged alternately in the foot width direction in a cross section in the foot width direction, when the sole is placed on the flat plane, wherein the upward protrusion has a shape curved to protrude upward and the downward protrusion has a shape curved to protrude downward, the center support portion includes a center projection including one of the upward protrusion and the downward protrusion configured centrally in the foot width direction, and a second projection including the other one of the upward protrusion and the downward protrusion configured inward or outward of the center projection contiguously to the center projection in the foot width direction, a length from an upper end of the upward protrusion to a lower end of the downward protrusion is largest in a center portion of the center support portion in a foot length direction, and decreases gradually from the center portion toward a front or a rear in the foot length direction, the midsole includes a lower midsole and an upper midsole connected onto the lower midsole, the plate is disposed between the lower midsole and the upper midsole, and the lower midsole includes a portion sandwiched between the front support portion and the outsole.

2. The sole according to claim 1, wherein the center support portion has a shape extending to a position configured to overlap, in the thickness direction of the sole, a cuboid bone of the wearer.

3. The sole according to claim 1, wherein the center support portion includes:

an inner projection configured inward of the center projection and contiguously to the center projection in the foot width direction; and an outer projection configured outward of the center projection and contiguously to the center projection in the foot width direction.

4. The sole according to claim 3, wherein the center projection is configured by the upward protrusion, and the inner projection and the outer projection are each configured by the downward protrusion.

5. The sole according to claim 3, wherein a curvature of the center projection, a curvature of the inner projection, and a curvature of the outer projection are identical to each other.

6. The sole according to claim 1, wherein the midsole and the plate are shaped such that, when a lowermost portion of the sole is placed on the flat plane, a boundary between the front support portion and the center support portion is located at a lowermost point of the plate closest to the flat plane, and a part of the plate that is located rearward of the boundary gradually extends upward away from the flat plane, toward a rear in a longitudinal direction of the sole, and the boundary is located at a point 35% of a length from a front end to a rear end of the midsole.

7. A shoe comprising:

a sole according to claim 6; and an upper connected to the sole and located over the sole.

* * * * *